US006840818B2

(12) United States Patent
Itou

(10) Patent No.: US 6,840,818 B2
(45) Date of Patent: Jan. 11, 2005

(54) CONNECTOR

(75) Inventor: Tomonari Itou, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/651,902

(22) Filed: Aug. 29, 2003

(65) Prior Publication Data

US 2004/0053537 A1 Mar. 18, 2004

(30) Foreign Application Priority Data

Sep. 9, 2002 (JP) ..... 2002-262362

(51) Int. Cl.[7] ..... H01R 33/00
(52) U.S. Cl. ..... 439/682
(58) Field of Search ..... 439/682, 686, 439/692, 752, 595, 594, 405

(56) References Cited

U.S. PATENT DOCUMENTS 3,517,803 A * 6/1970 Frompovicz ..... 206/716
4,693,532 A * 9/1987 Colleran et al. ..... 439/594
5,224,883 A * 7/1993 Yamamoto ..... 439/752
5,297,970 A * 3/1994 Carney ..... 439/108
6,146,215 A * 11/2000 Matsushita et al. ..... 439/752.5

FOREIGN PATENT DOCUMENTS

JP 2001-268751 9/2001

* cited by examiner

*Primary Examiner*—Alex Gilman
(74) *Attorney, Agent, or Firm*—Gerald E. Hespos; Anthony J. Casella

(57) ABSTRACT

A connector (10) has terminal fittings (11) each of which has a connecting portion (13) formed with slits (15) for receiving a busbar (B). The connector (10) also has a housing (21) with terminal accommodating chambers (22) arranged side-by-side in an arranging direction (AD) for receiving the terminal fittings (11). The arranging direction (AD) is normal to the slits (15). The terminal accommodating chambers (22) are displaced from the adjacent ones in a direction normal to the arranging direction (AD). As a result, the height of partition walls (24) between the adjacent terminal accommodating chambers (22) is shorter than the height of the terminal fitting (11), thereby preventing the slits (15) from being fit to the partition wall (24) at the time of inserting the terminal fitting 11.

6 Claims, 7 Drawing Sheets

CONNECTOR

BACKGROUND OF THE INVENTION

Field of the Invention

The invention relates to a connector to prevent erroneous insertion of a terminal fitting into a terminal accommodating chamber.

Japanese Unexamined Patent Publication No. 2001-268751 and FIGS. 5(A) and 5(B) herein show a known junction box. With reference to FIGS. 5(A) and 5(B), the known junction box 1 has a vertical busbar system with an internal circuit forming element 2 and busbars 3 that stand up side-by-side in the internal circuit forming element 2. The junction box 1 further has a casing 4 and a connector fitting 5 is provided on the upper surface of the casing 4. A connector 6 is provided with insulation-displacement terminal fittings 7 that are connected to a wiring harness W/H. The connector 6 is fitted into the connector fitting 5 so that the insulation-displacement type terminal fittings 7 in the connector 6 connect with the busbars 3. Thus, the wiring harness W/H is connected with the internal circuit forming element 2 of the junction box 1.

FIGS. 6(A) and 6(B) show a known female terminal fitting 8 that is directly connectable with the busbar 3 without using an intermediate terminal as described above. The terminal fitting 8 has a wire crimping portion 8*a* at one end and a rectangular tubular connecting portion 8*b* at the other end. A slit 8*c* is formed in opposite upper and lower side walls of the connecting portion 8*b* for receiving the busbar 3, and resilient contact pieces 8*d* are formed on the inner surfaces of the other opposite left and right side walls of the connecting portion 8*b* by bending to achieve resilient contact with the opposite surfaces of the busbar 3.

The terminal fitting 8 is used with a housing 9 that has side-by-side terminal accommodating chambers 9*a*, as shown in FIG. 7. The terminal fittings 8 are inserted and locked into the terminal accommodating chambers 9*a*, and the housing 9 then is mounted into the connector fitting 5 of the junction box 1.

The terminal fittings 8 must connect with the corresponding busbars 3 arranged side-by-side at required intervals. Thus, the terminal fittings 8 are accommodated in a positional relationship so that the slits 8*c* of the respective terminal fittings 8 face each other in a direction normal to the arranging direction of the respective terminal accommodating chambers 9*a* of the housing 9. However, the slits 8*c* may align with a partition wall 9*b* between the adjacent terminal accommodating chambers 9*a* and the terminal fitting 8 may be inserted erroneously over the two terminal accommodating chambers 9*a* (third terminal fitting 8 from left in FIG. 7). Such an erroneous insertion of the terminal fitting 8 requires the terminal fitting 8 to be reinserted, thereby reducing operational efficiency. Additionally, the terminal fitting may be damaged by forcibly inserting the slits 8*c* against partition wall 9*b*.

The present invention was developed in view of the above problem and an object thereof is to provide a connector that can prevent a terminal fitting that is directly connectable with a busbar from being damaged upon inserting the terminal fitting into a housing and to improve insertion operational efficiency.

SUMMARY OF THE INVENTION

The invention relates to a connector that has a housing formed with terminal accommodating chambers arranged side-by side. The connector further has terminal fittings that can be inserted into the terminal accommodating chambers along an inserting direction. Each terminal fitting has a wire connection portion for connection with a wire and a connecting portion formed with slits for receiving a busbar of a mating member. The slits extend substantially normal to the inserting direction of the terminal fittings into the accommodating chambers. Each terminal accommodating chamber is displaced from adjacent terminal accommodating chambers in a direction substantially normal to an arranging direction thereof and parallel to a longitudinal extension of the busbars. Thus, the height of the partition walls between the adjacent terminal accommodating chambers is smaller than the height of the respective terminal accommodating chambers. Accordingly, the partition walls cannot enter the slits of the terminal fittings, and the terminal fittings cannot be inserted erroneously between the adjacent terminal accommodating chambers instead of being inserted into the corresponding terminal accommodating chamber.

The connecting portion preferably comprises at least one resilient contact for contacting the busbar received by the slits.

Grooves for receiving the busbars preferably are formed at a connecting end of the housing at positions substantially corresponding to the slits of the terminal fittings that are to be accommodated in the terminal accommodating chambers so that the leading ends of the terminal fittings do not project from an end surface at the connecting end of the housing. Thus, the leading ends of the terminal fittings cannot be damaged by interference with external matter.

The housing may comprise resilient locks for locking the terminal fittings at proper positions in the respective accommodating chambers. Accordingly, the terminal fittings can be locked in positions in the connector housing for engagement with the corresponding busbar.

At least one stabilizer preferably is provided on the terminal fitting for restricting the orientation of the terminal fitting when the terminal fitting is inserted into the corresponding terminal accommodating chamber. Accordingly, the insertion of the terminal fitting in an improper orientation can be avoided, and operational efficiency is improved.

The stabilizer preferably is formed by bending an end of a first side wall to project through a window formed at a corner of an adjacent second side wall.

The terminal accommodating chambers preferably are arranged in stages in the housing. Accordingly, a sufficient number of terminal fittings can be arranged in the housing, e.g. for meeting the requirements of current capacity of the terminal fittings but concurrently allowing for a compact arrangement.

These and other features and advantages of the invention will become more apparent after reading the following description of preferred embodiments and accompanying drawings. It should be understood that even though embodiments are described separately, single features thereof may be combined.

DETAILED DESCRIPTION OF THE PREFERRED EMBODIMENT

Figure 1A:
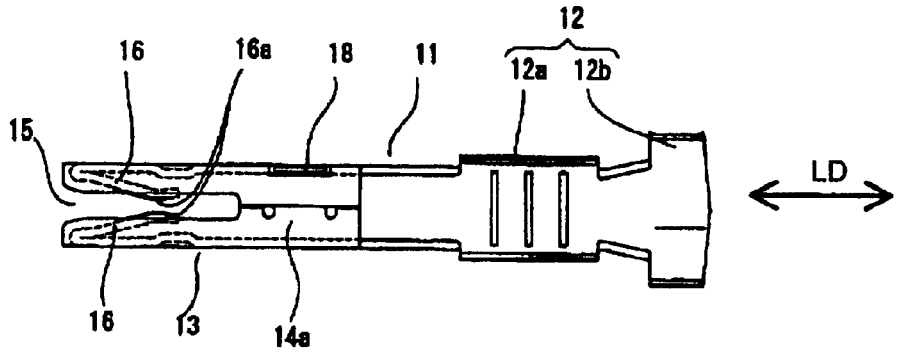
FIGS. 1(A), 1(B) and 1(C) are a plan view, a front view and a left side view of a terminal fitting of a connector according to one embodiment of the present invention.
Figure 1B:
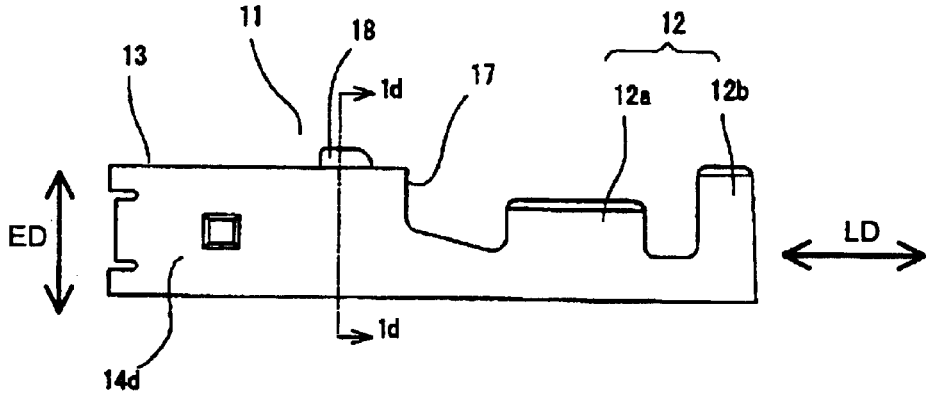
Figure 1C:
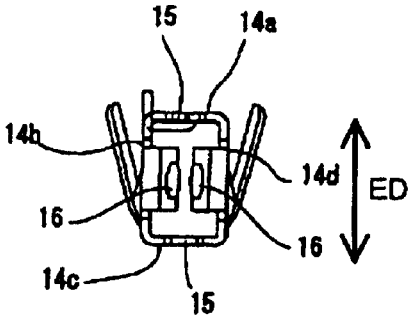

A connector according to the invention is identified by the numeral 10 in the accompanying drawings. The connector 10 has terminal fittings 11 to be connected with busbars B arranged substantially vertically and normal to a longitudinal direction LD of the terminal fittings 11 arranged substantially side-by-side in a junction box (not shown) and a housing 21.

The female terminal fitting 11 illustrated in FIGS. 1(A) to 1(D) is formed preferably by bending, folding and/or embossing a conductive metallic plate material cut or stamped into a specified shape. The terminal fitting 11 has a wire crimping portion 12 at one end and a connecting portion 13 at the opposite end. The wire crimping portion 12 has wire barrel 12*a* and an insulation barrel 12*b* to be crimped, bent or folded into connection with a core and an insulated portion of a wire W, respectively. Alternatively or additionally, the wire connecting portion may comprise a portion for connection with the wire W by insulation displacement, soldering, welding or the like connection means or via an additional terminal fitting.

The connecting portion 13 is configured for connection with the vertical busbar B. More particularly, the connecting portion 13 has four side walls 14*a*, 14*b*, 14*c*, 14*d* bent into a substantially rectangular tube. A slit 15 is cut at a middle position of each of the opposite upper and lower side walls 14*a*, 14*c* substantially along the longitudinal direction LD of the terminal fitting 11. The slit 15 has a width substantially corresponding to the thickness of the vertical busbar B. Thus, the vertical busbar B can be received in the slits 15. Each slit 15 has an extension direction ED arranged substantially normal to the longitudinal direction LD of the terminal fitting 11. The extension direction ED of the slit 15 also will be aligned substantially parallel to a busbar longitudinal direction BLD.

Figure 1D:
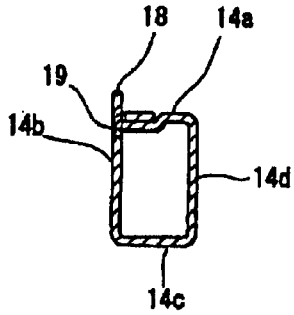
FIG. 1(D) is a section along 1(D)—1(D) of FIG. 1(B).

Two facing resilient contact pieces 16 are formed at the opposite left and right side walls 14*b*, 14*d* by folding projecting leading end portions of the left and right side walls 14*b*, 14*d* inwardly into a bent or pointed shape. Accordingly, the resilient contact pieces 16 are arranged at an angle to the longitudinal direction LD and are deflectable along a direction substantially normal to the extension direction ED. As shown in FIG. 1(A), facing vertices of the resilient contact pieces 16 define contacts 16*a* that project into the slits 15 for resiliently contacting the opposite surfaces of the vertical busbar B inserted into the slits 15. The rear end of the connecting portion 13 is formed with a step 17. Further, a stabilizer 18 projects up from the side wall 14*b* of the connecting portion 13. As shown in FIG. 1(D), the stabilizer 18 is formed by bending an end portion of the side wall 14*a* at the upper side to stand up through a window 19 formed at a corner of the side wall 14*b*.

Figure 2A:
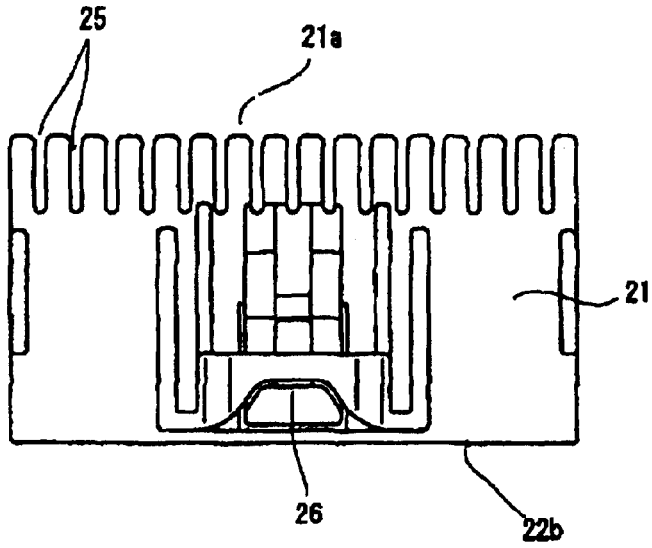
FIGS. 2(A), 2(B) and 2(C) are a plan view, a rear view and a side view of a housing.
Figure 2B:
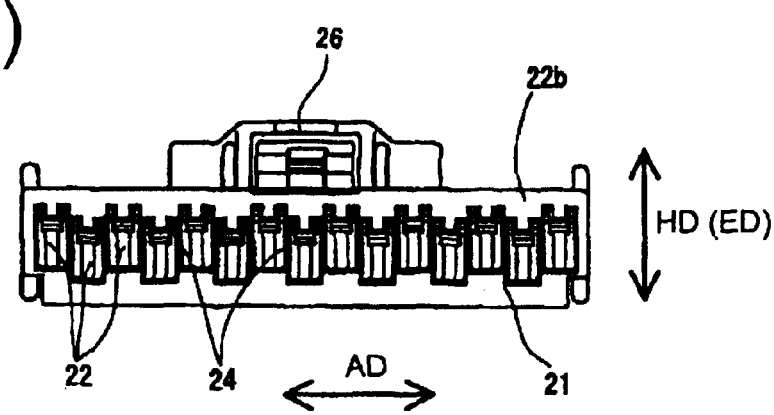
Figure 2C:
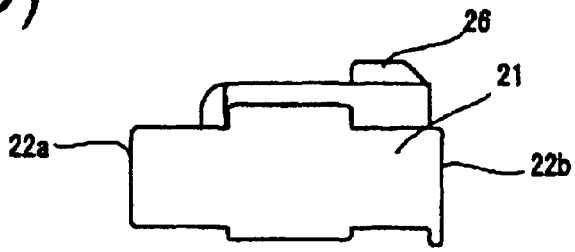
Figure 3:
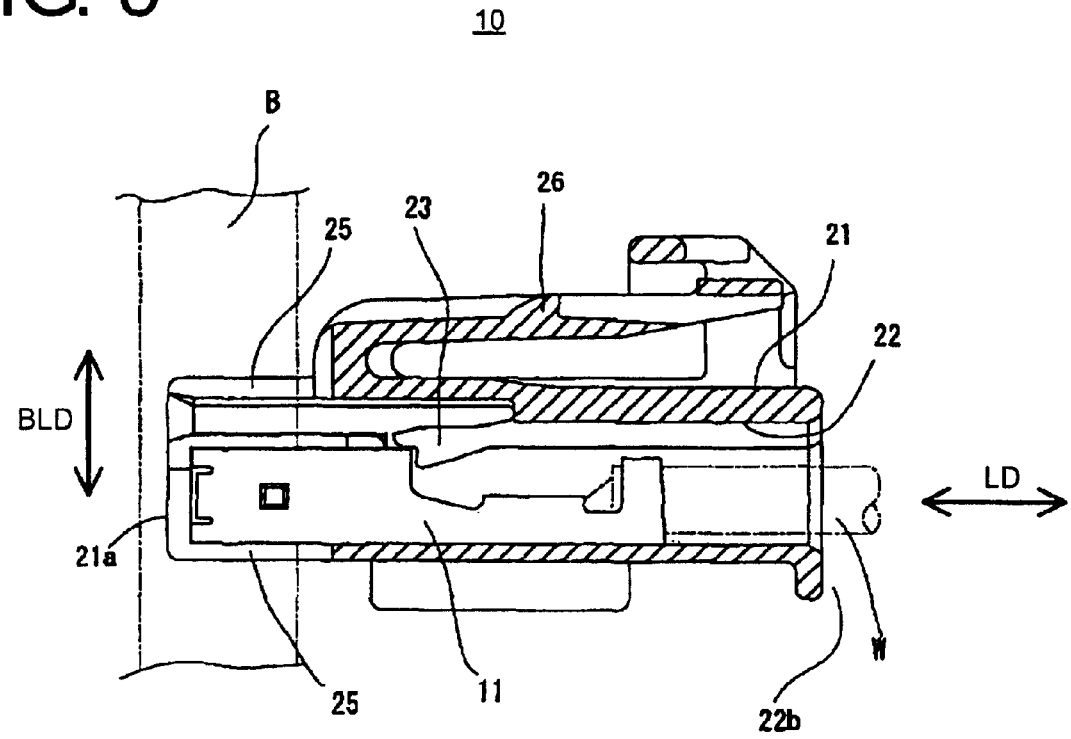
FIG. 3 is a longitudinal sectional view of the connector showing a state where the terminal fitting is inserted in the housing.

The housing 21 illustrated in FIGS. 2(A) to 2(C) is formed e.g. of a synthetic resin to define a substantially wide box shape. The housing 21 has side-by-side terminal accommodating chambers 22 arranged in plural stages for receiving the terminal fittings 11. As shown in FIG. 3, a resilient lock 23 is cantilevered toward a connecting surface 21*a* at the leading end of the housing 21 in each terminal accommodating chamber 22. The lock 23 is engageable with the step 17 at the rear end of the connecting portion 13 of the terminal fitting 11 to lock the terminal fitting 11. The terminal fittings 11 are accommodated in the side-by-side terminal accommodating chambers 22 so that the slits 15 of the terminal fittings 11 are arranged vertically. More particularly, the terminal accommodating chambers 22 are arranged substantially side-by-side in a direction AD normal to an extension direction ED of the slits 15 of the terminal fitting 11. Accordingly, the terminal fittings 11 in the terminal accommodating chambers 22 are arrayed along the arrangement direction AD for connection with the respective busbars B.

Figure 4:
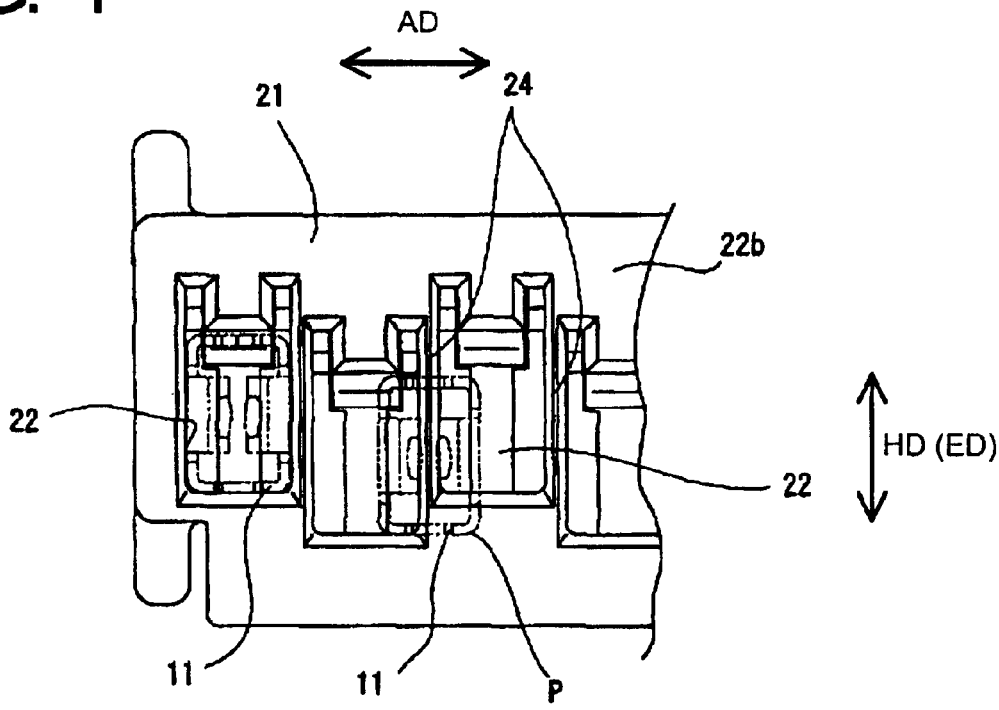
FIG. 4 is a view showing an essential portion of the rear surface of the housing and an inserted state of the terminal fitting.
Figure 5A:
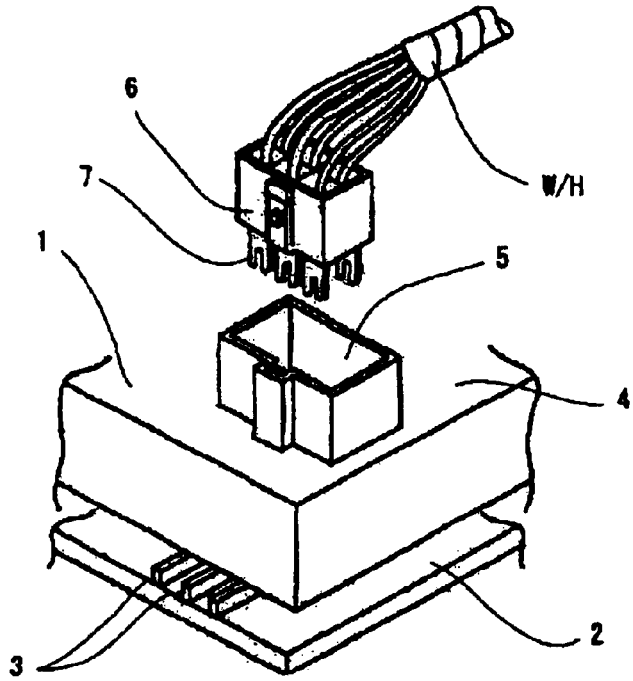
FIG. 5(A) PRIOR ART
FIGS. 5(A) and 5(B) are views of a prior art connector.
Figure 5B:
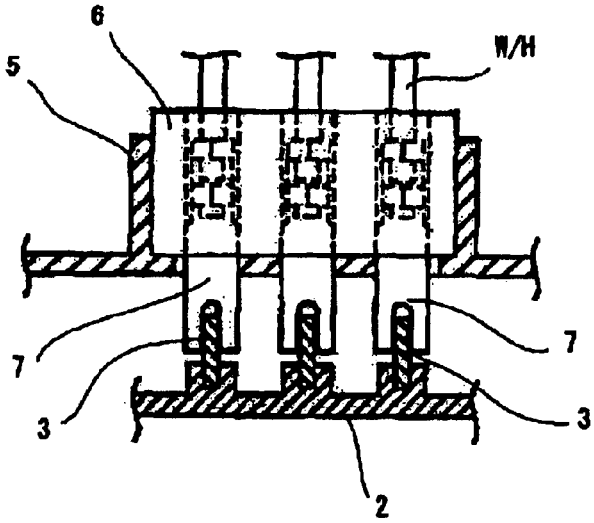
FIG. 5(B) PRIOR ART
Figure 6A:
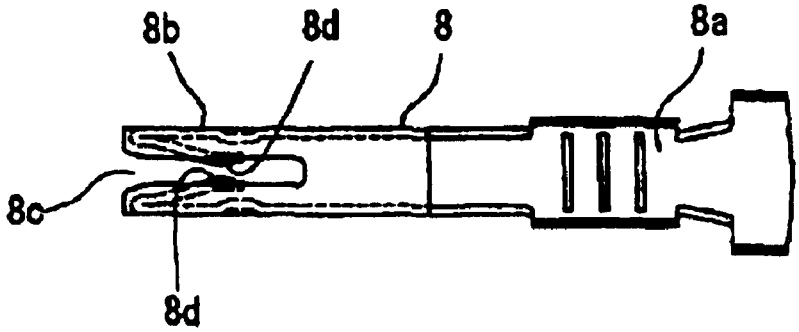
FIG. 6(A) PRIOR ART
FIGS. 6(A) and 6(B) are views of a prior art terminal fitting to be connected with a junction box.
Figure 6B:
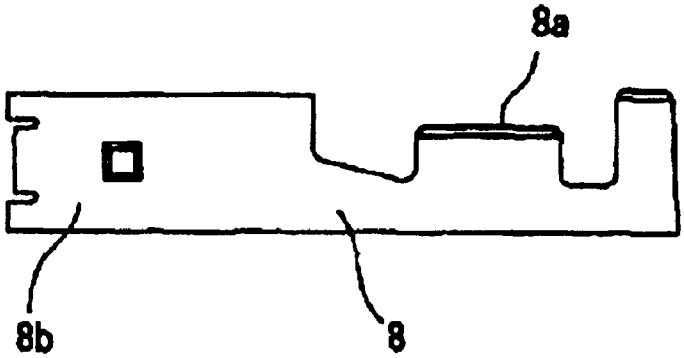
FIG. 6(B) PRIOR ART
Figure 7:
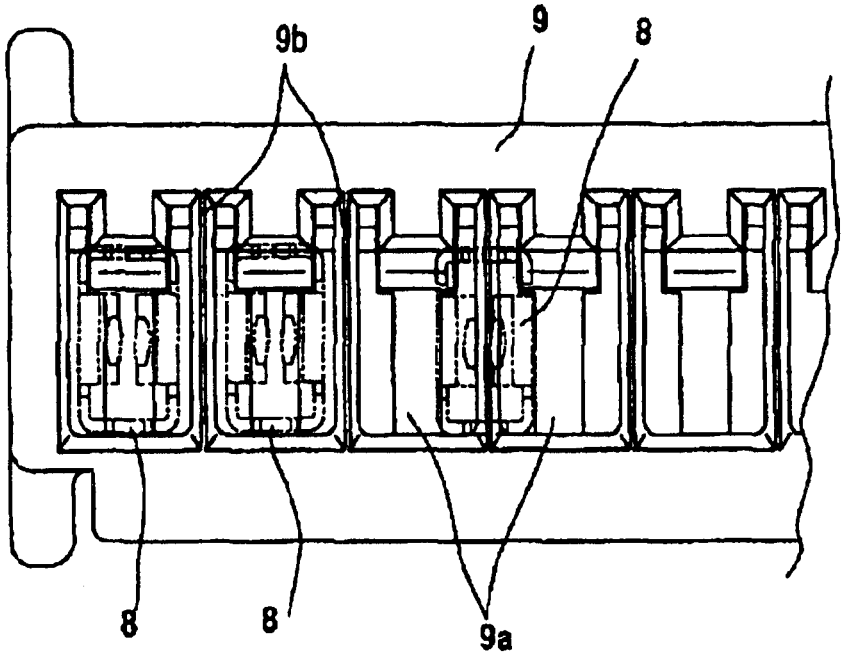
FIG. 7 PRIOR ART
FIG. 7 is a view showing an essential portion of a terminal inserting surface of a prior art housing.

Adjacent terminal fittings 22 are offset and slightly displaced from each other in a height direction HD substantially normal to the arranging direction AD of the terminal accommodating chambers 22. Thus, as shown in FIG. 4, a vertical dimension of partition walls 24 between the adjacent terminal accommodating chambers 22 is shorter than the heights of the terminal accommodating chambers 22 and the terminal fittings 11.

Grooves 25 are formed in the upper and lower surfaces of the housing 21 at the side of the connecting surface 21*a*, as shown in FIG. 2(A). Each groove 25 has a depth and width to receive the corresponding vertical busbar B at a position corresponding to the slits 15 of the terminal fitting 11 in each terminal accommodating chamber 22. In this way, the terminal fittings 11 are connected with the corresponding vertical busbars B without causing the leading ends of the terminal fittings 11 to project out from the connecting surface 21*a* of the housing 21. A lock arm 26 is provided at an upper part of the housing 21 and is engageable with a mating lock to lock the connector 10 so as not to come out of a connector fitting of the junction box.

The wire crimping portion 12 of the terminal fitting 11 is first crimped, bent or folded into connection with an end of one of the wires W of a wiring harness, as shown in FIG. 3. The terminal fitting 11 then is inserted into the corresponding terminal accommodating chamber 22 of the housing 21. The insertion of each terminal fitting 11 starts with the slits 15 vertical and the stabilizer 18 facing up. Thus, the terminal fittings 11 are accommodated in the respective accommodation chambers 22 so that the extension directions ED of the slits 15 are substantially parallel to each other and to the longitudinal direction BLD of the busbars B.

The terminal fitting 11 may be inserted improperly with the slits 15 of the terminal fitting 15 aligned with the partition wall 24 between the side-by-side terminal accommodating chambers 22. However, as shown in FIG. 4, the adjacent terminal accommodating chambers 22 are displaced from each other in the height direction HD, and the height of the partition wall 24 is shorter than the height of the terminal fitting 11. As a result, the slits 15 cannot be aligned with the partition wall 24 (position P in FIG. 4), and the terminal fitting 11 cannot be inserted improperly. Further, even if the terminal accommodating chambers 22 are vertically displaced from each other, such displacements are in the facing direction of the slits 15 of the respective terminal fittings 11 and along the longitudinal direction of the busbars B. Thus, the connection of the terminal fittings 11 with the vertical busbars B is not hindered or impaired.

The resilient lock 23 engages the step 17 of the terminal fitting 11, as shown in FIG. 3, to hold the terminal fitting 11 in the respective accommodating chamber 22. In this state, the slits 15 of the terminal fittings 11 align with the grooves 25 of the housing 21. The connector 10 then is fit into the fitting portion of the junction box (not shown). The vertical busbars B stand up substantially side-by-side and are received by the connecting surface 21*a* through the slits 15 and the grooves 25. Simultaneously, the opposite resilient contact pieces 16 contact opposite surfaces of each vertical busbar B to establish electrical contact between the terminal fitting 11 and the vertical busbar B.

Each terminal fitting 11 is inserted into a corresponding one of the side-by-side terminal accommodating chambers 22 in the housing 21 so that the slits 15 can be connected with the busbar B. However, the slits 15 are prevented from being fit to the partition wall 24 between the adjacent terminal accommodating chambers 22. As a result, the deformation of the terminal fitting 11 is prevented, and operational efficiency of inserting the terminal fitting 11 is improved without requiring the inserting operation to be redone.

What is claimed is:

1. A connector, comprising:

terminal fittings each having opposite first and second ends, a wire connection portion at the first end of each terminal fitting, the wire connection portion being configured to be connected with a wire and a connecting portion at the second end of the terminal fitting, the connecting portion being formed with slits extending entirely through portions of the respective terminal fitting adjacent the second end for receiving a busbar of a mating member; and a housing with terminal accommodating chambers for receiving the terminal fittings, the terminal accommodating chambers being arranged substantially side-by-side in an arranging direction to define at least one substantially side-by-side array extending substantially normal to an extension direction of the slits so that each of said terminal accommodating chambers in the side-by-side array is separated from at least one adjacent terminal accommodating chamber in the array by a partition wall, each of said terminal accommodating chambers in said array being displaced from each of said adjacent terminal accommodating chambers in a height direction substantially normal to the arranging direction of the array so that each said partition wall defines a dimension in the height direction that is less than heights of the respective terminal accommodating chambers measured in the height direction.

2. The connector of claim 1, wherein the connecting portion comprises at least one resilient contact piece for contacting the busbar received by the slits.

3. The connector of claim 1, wherein grooves for receiving the busbars are formed at a connecting surface of the housing at positions substantially corresponding to the slits of the terminal fittings in the terminal accommodating chambers so that the leading ends of the terminal fittings do not project from the connecting surface.

4. The connector of claim 1, wherein the housing comprises resilient locks for locking the terminal fittings inserted to a proper position in the corresponding accommodating chamber.

5. The connector of claim 1, wherein at least one stabilizer is provided on the terminal fitting for restricting a rotational orientation of the terminal fitting when the terminal fitting is inserted into the corresponding terminal accommodating chamber of the housing.

6. The connector of claim 5, wherein the stabilizer is formed by bending an end portion of a first side wall to project through a window formed at a corner of an adjacent second side wall.

* * * * *